US008281545B2

(12) United States Patent
Choi

(10) Patent No.: US 8,281,545 B2
(45) Date of Patent: Oct. 9, 2012

(54) METHOD FOR RETROFITTING REINFORCED CONCRETE COLUMN USING MULTI-LAYERED STEEL PLATES, AND RETROFITTING STRUCTURE OF REINFORCED CONCRETE COLUMN USING THE SAME

(75) Inventor: Eun Soo Choi, Seoul (KR)

(73) Assignees: Kwang-Won Ind Co., Ltd., Hwaseong-Si (KR); Eun Soo Choi, Seoul (KR)

( * ) Notice: Subject to any disclaimer, the term of this patent is extended or adjusted under 35 U.S.C. 154(b) by 386 days.

(21) Appl. No.: 12/245,897

(22) Filed: Oct. 6, 2008

(65) Prior Publication Data

US 2009/0165404 A1 Jul. 2, 2009

(30) Foreign Application Priority Data

Oct. 9, 2007 (KR) ..... 10-2007-0101283

(51) Int. Cl.
*E04B 1/00* (2006.01)
*E04G 21/00* (2006.01)
*E04G 23/00* (2006.01)

(52) U.S. Cl. ..... 52/745.17; 52/847; 52/848; 52/835; 52/745.04

(58) Field of Classification Search ..... 52/745.17, 52/745.04, 834, 847, 848, 296, 835, 223.5, 52/831, 836, 223.3, 223.13, 223.14, 231, 52/248, 514; 264/32; 228/144, 44.3, 151, 228/212

See application file for complete search history.

(56) References Cited

U.S. PATENT DOCUMENTS

| | | | | |
|---|---|---|---|---|
| 3,789,867 | A * | 2/1974 | Yabor | 137/227 |
| 4,023,374 | A * | 5/1977 | Colbert et al. | 405/216 |
| 4,092,079 | A * | 5/1978 | Swanson | 403/306 |
| 4,738,058 | A * | 4/1988 | Svensson | 52/98 |
| 5,900,195 | A * | 5/1999 | Pool et al. | 264/46.5 |
| 6,062,342 | A * | 5/2000 | Dobson | 182/230 |
| 6,123,485 | A * | 9/2000 | Mirmiran et al. | 405/252 |
| 6,167,673 | B1 * | 1/2001 | Fournier | 52/848 |
| 6,513,291 | B2 * | 2/2003 | Gilsdorf | 52/297 |
| 6,705,058 | B1 * | 3/2004 | Foust et al. | 52/296 |
| 6,938,392 | B2 * | 9/2005 | Fouad et al. | 52/834 |
| 7,343,718 | B2 * | 3/2008 | Foust et al. | 52/745.17 |
| 7,556,752 | B1 * | 7/2009 | Hicks | 264/32 |

FOREIGN PATENT DOCUMENTS

| | | |
|---|---|---|
| JP | 2002-371795 | 12/2002 |
| KR | 1020060126200 | 12/2006 |

* cited by examiner

*Primary Examiner* — William Gilbert
*Assistant Examiner* — Chi Q Nguyen
(74) *Attorney, Agent, or Firm* — J.C. Patents

(57) ABSTRACT

A method for retrofitting a reinforced concrete column by compressing a reinforcing plate including a steel plate using an external pressure is provided. The reinforcing plate is compressed to double-layer or more, that is, multi-layer in due order, on the reinforced concrete column. Accordingly, since a workability of the retrofit is excellent and since the reinforcing plate is easily compressed on the surface of the reinforced concrete column by a small lateral pressure, sufficiently the reinforced concrete column could be reinforced. Besides, a compressive strength of the reinforced concrete column could be increased. In addition, the flexibility of the reinforcing plate and the energy absorption force of the reinforcing plate could be increased.

8 Claims, 8 Drawing Sheets

FIG. 5A

| Specimen Classification | 1 (Mpa) | 2 (Mpa) | 3 (Mpa) | Average (Mpa) |
|---|---|---|---|---|
| Plain | 26.0 | 27.5 | — | 26.8 |
| 1.0mm | 38.5 | 40.0 | 38.0 | 38.8 |
| 1.5mm | 45.6 | 44.6 | 43.0 | 44.4 |
| 2.0mm | 48.6 | 50.5 | 50.2 | 49.8 |

METHOD FOR RETROFITTING REINFORCED CONCRETE COLUMN USING MULTI-LAYERED STEEL PLATES, AND RETROFITTING STRUCTURE OF REINFORCED CONCRETE COLUMN USING THE SAME

CROSS-REFERENCE TO RELATED APPLICATION

This application claims the priority benefit of Korean application serial no. 10-2007-0101283, filed Oct. 9, 2007. All disclosure of the Korean application is incorporated herein by reference.

FIELD OF THE INVENTION

The present invention relates to a method for retrofitting a reinforce concrete column using multi-layered steel plates, and more particularly, to a method for retrofitting a reinforced concrete column by compressing a reinforcing plate such as a steel plate on the surface of the reinforced concrete column with a low strength and a low ductility ratio, and retrofitting structure of reinforced concrete column using the same.

BACKGROUND OF THE INVENTION

In order to establish earthquake-proof performance of conventional reinforced concrete columns, research works in relation to methods for retrofitting the concrete columns has been advanced for quite a long time, and accordingly, the various results of the research works is published.

As representative seismic retrofitting methods, there are a retrofitting method using a steel plate, and a retrofitting method using a strip band of composite materials such as GFRP (Glass Fiber Reinforced Plastic), CFRP (Carbon Fiber Reinforced Plastic) or the like.

For the retrofit using the steel plate, a grouting process is substantially performed between surfaces of the steel plate and the concrete, and accordingly, there is a problem that a shape of an external and a shape of reinforced concrete column may be changed.

Also, the retrofitting method using the composite materials such as GFRP or CFRP uses adhesives such as an epoxy or the like in order to bond the composite materials. In this case, there is a problem that the retrofitting effect may be decreased because Young's modulus of the adhesives is very small.

In order to overcome the drawbacks, "a retrofitting method for compressing a steel plate using an external pressure" is recently developed. The method may be performed without a grouting process, and the method have the high effect of reinforcing due to not having soft materials such as the epoxy on surfaces of the reinforcing plate and the concrete. In addition, the method has the advantage that a lateral pressure applied from an external may increase an entire resisting force of the reinforced concrete column by withstanding a crack and breakdown of the concrete.

FIG. 1 illustrates a retrofitting method for a reinforced concrete column according to the prior art.

Referring to FIG. 1, in the conventional retrofitting method, a steel plate 10 with a prescribed thickness is firstly manufactured to form a cylindrical shape, and, then, the steel plate 10 is installed to wrap a circumference of a reinforced concrete column 100.

After the steel plate 10 is installed to wrap a circumference of a reinforced concrete column 100, a lateral pressure is applied from the outside using a compress machine commonly available in relevant fields that may use a clamp or a band plate, and, then, the steel plate 10 is compressed on the surface of the reinforced concrete column 100 by the lateral pressure.

Then, an edge surface of the steel plates 10 opposite to each other is welded to be tightly attached using a welding process such as a Tungsten Inert Gas (TIG) welding process.

Next, a welded portion of the edge surface A is grinded to flat by a grinder, and a strip-shaped steel plate 20 is welded to reinforce at welded surface so as to prevent the breakdown of the welded portion.

In case of using the above-mentioned steel plate 10, since the process for compressing the steel plate 10 on the reinforced concrete column 100 is inevitably performed, the retrofit effect may be affected by the thickness of the steel plate 10 and the welding performance of the edge surface. If the retrofitting has the same effect, it is a matter of course that the retrofit should be excellent in constructability, workability and economical efficiency.

Although its constructability is better if the thickness of the steel plate is thin, the retrofit have little effect if a cross-sectional size of the concrete column is large. On the other side, although the retrofit have an effect if the thickness of the steel plate is thick, its constructability becomes worse since the lateral pressure for compressing must be more applied. Therefore, in the retrofitting method for compressing the steel plate 10 on the reinforced concrete column 100 using the external pressure, it is very important that the optimum thickness of the steel plate 10 is determined, but it is very difficult that the thickness of the steel plate 10 is determined in a practical manner.

SUMMARY OF THE INVENTION

Accordingly, the present inventions may be directed to provide a method for retrofitting a reinforced concrete column using multi-layered steel plates on the basis of the retrofitting method for compressing a steel plate using an external pressure, wherein, the method may not use the thick steel plate, and the method may use the thin steel plates which has a convenient workability to be at least two or more multi-layer. Accordingly, the method may have a convenient constructability and may be optimal the retrofitting effect of the reinforced concrete column.

The present inventions may provide a method for retrofitting a reinforced concrete column using multi-layered steel plates, comprising the steps of: compressing a first reinforcing plate on the reinforced concrete column where the first reinforcing plate is equipped to directly contact to wrap an outer surface of the reinforced concrete column; tightly bonding an edge surface for connecting the first reinforcing plate on the reinforced concrete column so as to consolidate the compressed first reinforcing plate; compressing a second reinforcing plate on the first reinforcing plate where the second reinforcing plate is equipped to directly contact to wrap an outer surface of the first reinforcing plate; and tightly bonding an edge surface for connecting the second reinforcing plate to the first reinforcing plate so as to consolidate the compressed second reinforcing plate, wherein, at least double-layered or more reinforcing plates are compressed on the outer surface of the reinforced concrete column in sequence, and the first and second reinforcing plates are made from steel plates.

The present inventions may provide a retrofit for retrofitting a concrete column using multi-layered steel plates, comprising: a first reinforcing plate being equipped and compressed to directly contact to wrap an outer surface of the reinforced concrete column, and being tightly bonded by a welding process so as to consolidate an edge surface for connecting to the reinforced concrete column, wherein the first reinforcing plate is made from a steel plate; a second reinforcing plate being equipped and compressed to directly contact to wrap an outer surface of the first reinforcing plate, and being tightly bonded by a welding process so as to consolidate an edge surface for connecting to the first reinforcing plate, wherein the second reinforcing plate is made from at least one layer or more steel plates; and at least one or more strip reinforcing plates being formed by a welding process so as to traverse the edge surface in the outermost of the second reinforcing plates, wherein the strip reinforcing plate is made from a steel plate.

BRIEF DESCRIPTION OF THE DRAWINGS

FIG. 5A illustrates a table for showing a experimental results of a retrofitting method according to an embodiment of the present invention.

DETAILED DESCRIPTION OF EXEMPLARY EMBODIMENT(S)

The embodiments of the present inventions are not to be limited in scope by the specific embodiments described herein, from the foregoing description and accompanying drawings. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims.

The retrofitting method according to the present invention is on the assumption that a reinforcing plate 200 including a steel plate is compressed to reinforce a reinforced concrete column 100 using an external pressure.

Figure 1:
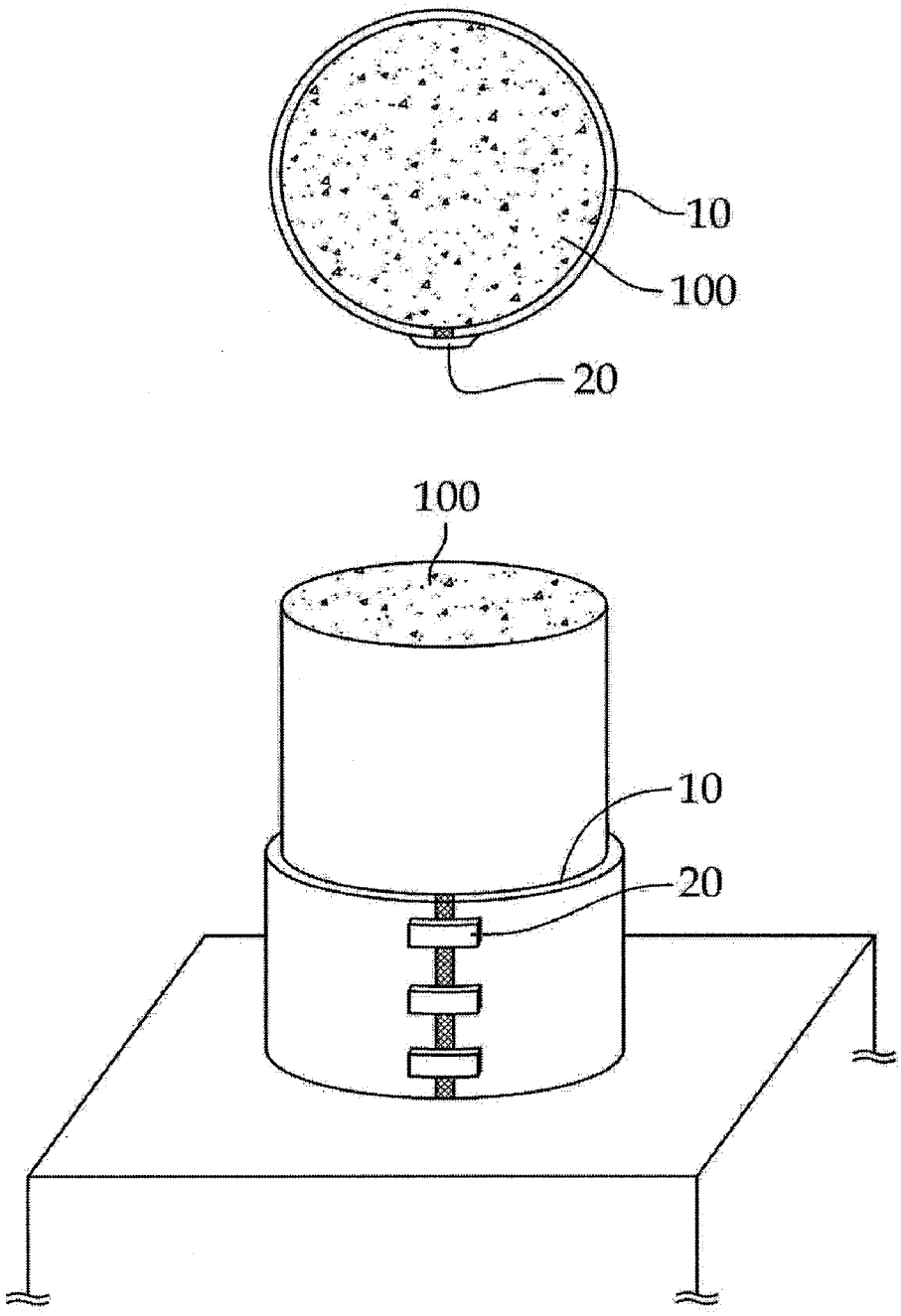
FIG. 1 (Prior Art)
FIG. 1 illustrates a retrofitting method for a reinforced concrete column according to the prior art.
Figure 2:
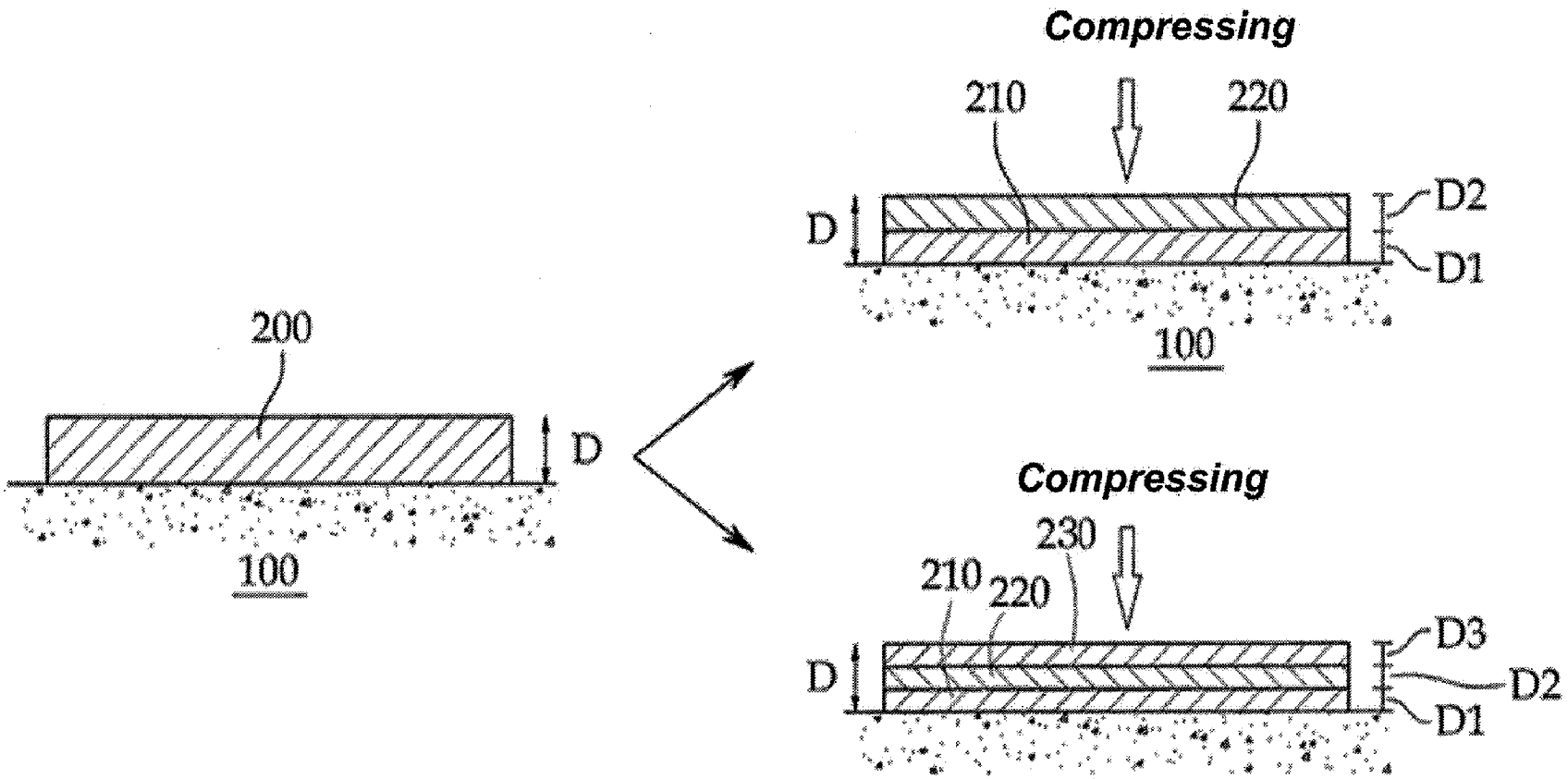
FIG. 2 illustrates schematically a principle of multi-layered steel plates according to an embodiment of the present invention.

FIG. 2 illustrates schematically a principle of multi-layered steel plates according to an embodiment of the present invention, in which a reinforcing plate 210 and 220 is equipped to compress on the reinforced concrete column 100.

As shown in a left side of FIG. 2, the reinforcing plate 200 which is a steel plate with a prescribed thickness is firstly formed to have a thickness D enough to reinforce the reinforced concrete column 100.

Although the thickness D of the reinforcing plate 200 is determined on the based of a sectional size of the reinforced concrete column 100 to be reinforced, the reinforcing plate 200 to be equipped on a portion for connecting the reinforced concrete column 100 and the base portion, must be formed to be very thick in consideration of earthquake-proof of the reinforced concrete column 100.

Accordingly, in case the reinforcing plate 200 with the large thickness is difficult to be available in ready-made goods, the reinforcing plate 200 have to be made to order, and therefore the cost of the reinforcing plate 200 may be so increased because the reinforcing plate 200 is produced by the order.

Besides, the retrofit have an effect when the reinforcing plate 200 is compressed on the reinforced concrete column 100. Since the reinforcing plate 200 with a sufficient thickness is formed in corresponding to a surface shape of the reinforced concrete column 100, it is very difficult to perform a bending process as well as the compress process.

If a large-capacity compress machine is used for compressing the thick reinforcing plate 200, the manufacturing cost may increase, and a quality control may be difficult since an accuracy of the work must increase.

According to the present invention, as shown in a right upper side of FIG. 2, in order to form the reinforcing plate 200 with a prescribed thickness D, the first reinforcing plate 210 is firstly compressed on the reinforced concrete column 100.

In comparison with the reinforcing plate 200 as shown in the left side of FIG. 2, the first reinforcing plate 210 is formed to have smaller thickness D1 than the thickness D. Accordingly, it gives a facility of bending and compressing process, and it improves selectiveness for purchasing the reinforcing plate 210.

On a contact surface between the first reinforcing plate 210 and the second reinforcing plate 220, grouting material such as epoxy material may be formed to improve an adhesive force of the contact surface. But, this grouting material is of no use in consideration with the retrofitting effect, and if the grouting material is damaged, the retrofitting effect of the reinforced concrete column 100 may rather decrease in the long run.

Therefore, since the first reinforcing plate 210 and the second reinforcing plate 220 according to the present invention use thin steel plates, the contact performance between them may be acquired sufficiently, and there is no need to use the grouting material decisively. Consequently, the retrofitting process of the reinforced concrete column 100 may be progressed quite easily.

In addition, as shown in a right bottom side of FIG. 2, an additional reinforcing plate 230 may be formed to wrap the second reinforcing plate 220 again. This additional reinforcing plate 230 may be optional, and it is preferable that the second reinforcing plate 220 according to the present invention is formed to be at least one layer or more.

Besides, in comparison, in order to acquire the same thickness D, one-layered reinforcing plate 200 with multi-layered reinforcing plates which two or more reinforcing plates 210 and 220 are formed in multi-layer, the multi-layered thin reinforcing plates in the two or more reinforcing plates 210 and 220 may be compressed without a gap. Here, the innermost reinforcing plate of the two or more reinforcing plates 210 and 220 is yielded, and at the same time the outermost reinforcing plate of the two or more reinforcing plates 210 and 220 is yielded. Accordingly, the two or more reinforcing plates 210 and 220 may equally work with the one-layered thick reinforcing plate 200 yielded at once. It may know the fact that the double-layered or thinner reinforcing plate 210 and 220 may have the same strength with the one-layered thick reinforcing plate 200.

Also, in case where the retrofit of the welding portion is additionally performed in which the second reinforcing plate 220 formed at the outermost is reinforced by means of a strip reinforcing plate 300, it may overcome a weakness of the welding portion that is formed on the edge surface for connecting the first reinforcing plate 210 and the second reinforcing plate 220. Accordingly, the retrofitting effect of the reinforced concrete column 100 may be increased still more.

Figure 3:
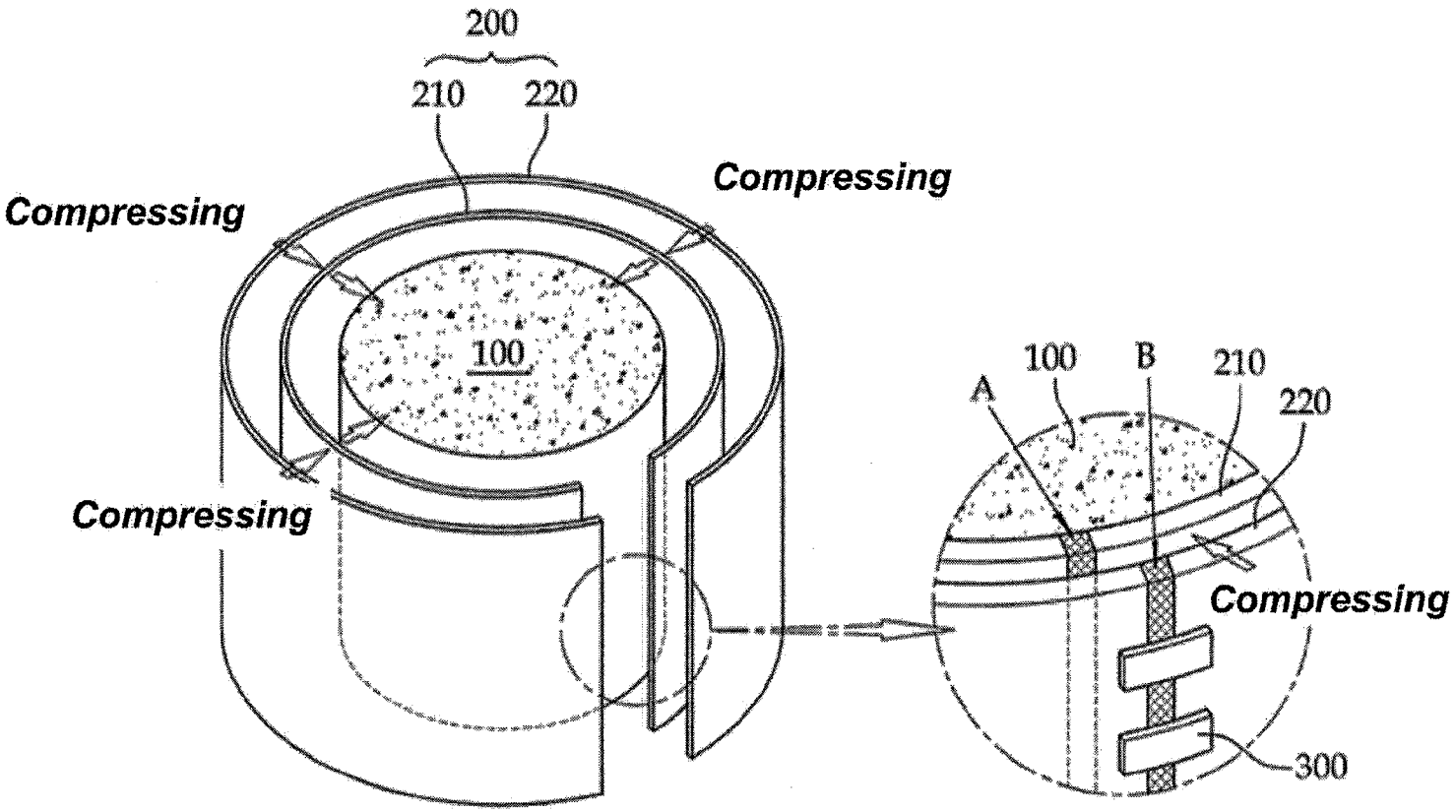
FIGS. 3 and 4 illustrate a retrofitting method according to an embodiment of the present invention, respectively.
Figure 4:
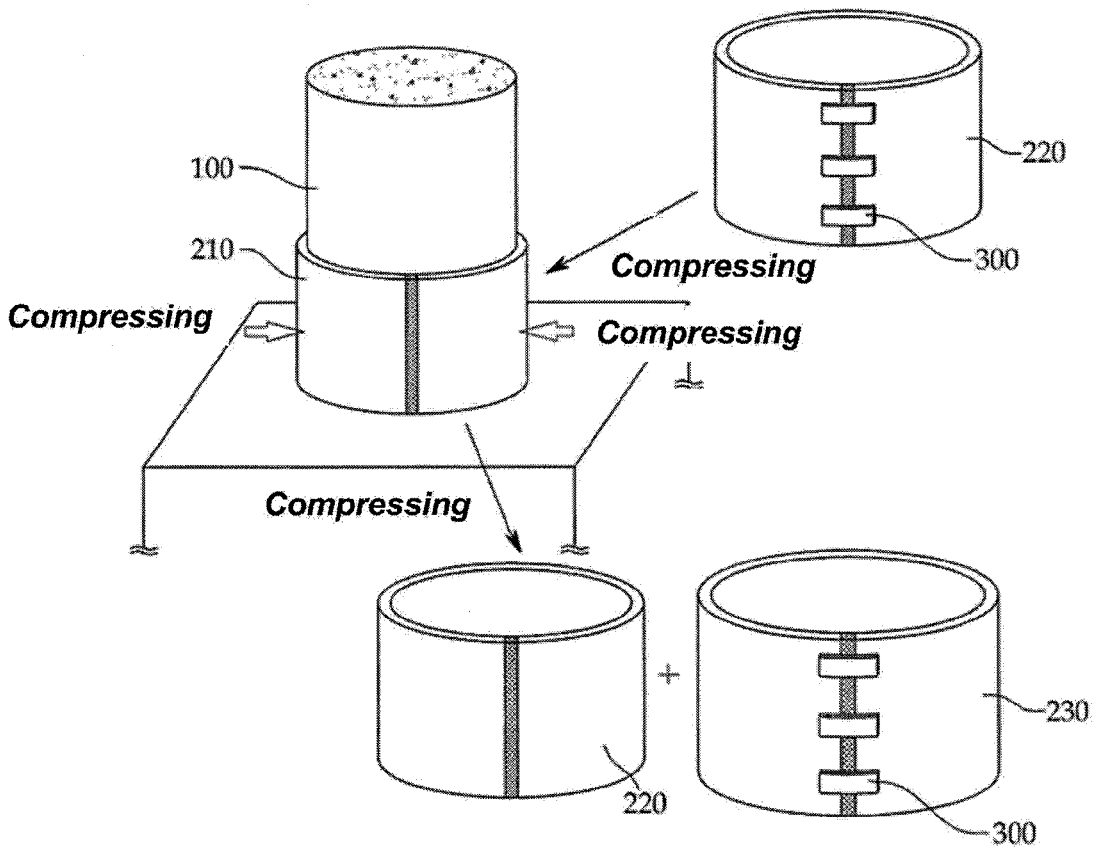

Now, a retrofitting method of the reinforced concrete column 100 according to the present invention is explained referring to FIGS. 3 and 4. FIGS. 3 and 4 illustrate the retrofitting method according to an embodiment of the present invention, respectively.

The reinforced concrete column 100 is a circular sectioned reinforced concrete column or a rectangular sectioned reinforced concrete column constructed as the reinforcing plate. On the basis of a bridge, the reinforced concrete column 100 may be a concrete column which is extension-protruded upwardly from a upper surface of the base 110 formed on the ground in a bridge bent and in which a coping portion is formed thereon.

The reinforced concrete column 100 according to the present invention is explained on the basis of the circular sectioned reinforced concrete column which is generally used.

The reinforced concrete column 100 is worked as a concrete column which transmits a load into the ground, the load being applied from a upper structure of the bridge. Recent, in consideration with the earthquake, the retrofit of the conventional reinforced concrete column 100 is being watched with keen interest.

The earthquake load is a lateral load, particularly, the earthquake load intensively affects the connection portion of the reinforced concrete column 100 and the base 110. Accordingly, the reinforced concrete column 100 is generally reinforced on the connection portion.

As shown in FIGS. 3 and 4, the first reinforcing plate 210 according to the present invention is wrapped the bottom side of the reinforced concrete column 100 and then is compressed.

The first reinforcing plate 210 is made by bending a steel plate to have a circular shape, and the size of the first reinforcing plate 210 may be prescribed in advance in consideration with the sectional size of the reinforced concrete column 100.

That is, the first reinforcing plate 210 uses a steel plate which is bended into the circular shape by means of a bending machine so as to wrap the reinforced concrete column 100. Although the steel plate is the best materials up to now, another materials such as GFRP (Glass Fiber Reinforced Plastic), CFRP (Carbon Fiber Reinforced Plastic) or the like may be used in the first reinforcing plate 210 if have the same effect with the steel plate.

The thickness D1 of the first reinforcing plate 210 is formed to be thinner than the thickness D of the reinforcing plate 200 to at least acquire for the retrofit of the reinforced concrete column 100. By doing this, the convenience of the bending process, transporting process and compressing process of the first reinforcing plate 210 may be satisfied.

The first reinforcing plate 210 manufactured above-mentioned is equipped to wrap the bottom side of the reinforced concrete column 100, and then it is compressed on the reinforced concrete column 100 using a general compress machine An effect of the compress may hold with which the edge surface A opposite to each other is connected and tightly attached in a state that the first reinforcing plate 210 is compressed. The most general method is a welding process which welds the edge surface A for connecting the first reinforcing plate 210 which is a steel plate.

When the first reinforcing plate 210 is compressed on the reinforced concrete column 100, a circular steel plate of a non-consolidation structure is equipped so that the edge surface A of the first reinforcing plate 210 and the reinforced concrete column 100 must be apart from each other. Then, by tightly bonding the first reinforcing plate 210 and the reinforced concrete column 100 by means of the welding portion formed by welding the edge surface A, the circular steel plate may be constructed in a consolidation state.

Although the tightly bonding process of the edge surface A may be performed by the welding process, it is not to be limited in this welding process. A method for applying a ceramic coating material into a metal form may be practicable, the metal form being manufactured along with a welding bead on the edge surface A of opposite to each other.

The welding portion may be a flat state by grinding its surface, and accordingly, the second reinforcing plate 220 which will be described later may be compressed uniformly.

As the above described, if the compressing process of the first reinforcing plate 210 and the tightly bonding process of the edge surface are finished, the second reinforcing plate 220 manufactured along with the first reinforcing plate 210 is equipped to wrap the first reinforcing plate 210, and then, as shown in FIGS. 3 and 4, the second reinforcing plate 220 is directly compressed on the first reinforcing plate 210 using a compress machine. Then, the edge surface B of the second reinforcing plate 220 is tightly attached by means of the welding process in order to hold the compressing force.

Therefore, it may know the fact that the reinforcing plate 200 according to the present invention may be comprised of multi-layered reinforcing plates by means of at least one layered first reinforcing plate 210 and double-layered second reinforcing plate 220.

Although the thickness D2 of the second reinforcing plate 220 may be equal to the thickness D1 of the first reinforcing plate 210, it may be different from the thickness D1 of the first reinforcing plate 210 since it may be properly adjusted according to the optimum thickness D.

Besides, the second reinforcing plate 220 may be constructed to be at least one-layered or more, and it may be determined according to the final thickness D of the reinforcing plate 200, a constructability, a workability and an field circumstance and the like If the second reinforcing plate 220 may be formed to be double-layered as shown in FIG. 4, reinforcing plate will be formed to be three-layered in all since the first reinforcing plate 210 is formed to be one-layered, and the second reinforcing plate 220 is formed to be double-layered on the reinforced concrete column. The double-layered second reinforcing plate 220 may be compressed in the same manner with the one-layered first reinforcing plate 210.

In addition, the contact surface of the first reinforcing plate 210 and the second reinforcing plate 220 may be formed without the grouting materials or adhesives such as the epoxy material. The grouting materials or adhesives are not to use inevitably for retrofitting the reinforced concrete column 100. Each of adhesion characteristics between the upper surfaces of the first reinforcing plate 210 and the second reinforcing plate 220 may be secured by means of a spot weld or the like in order to secure only the unification of the first reinforcing plate 210 and the second reinforcing plate 220.

Also, in case of the edge surface B of the second reinforcing plate 220, the welding portion is formed by the welding process. Then, the welding portion may be need to be protected and reinforced since the welding portion is exposed on the outside and is corroded according to elapsed-time.

Therefore, it is preferable that the welding portion must be prevented from corroding owing to the outside exposure using ceramic coating materials. The retrofit of the welding portion may be accomplished by a strip reinforcing plate 300 which is a strip-shaped steel plate, wherein the strip reinforcing plate 300 is traversed the welding portion of the edge surface and is welded.

Although there is no need to form the strip reinforcing plate 300 on the edge surface of the first reinforcing plate 210, the strip reinforcing plate 300 may be additionally formed on the edge surface of the second reinforcing plate 220, and accordingly, the retrofit of the welding portion and the flexibility of the reinforcing plate 200 may be increase.

That is, the strip reinforcing plate 300 is formed on the edge surface of the second reinforcing plate 220 at the outermost of the second reinforcing plate 220, and accordingly, the retrofitting effect of the reinforcing plate 200 may increase.

According to the present invention, the reinforcing plate is compressed to be double-layered or more, that is, multi-layered in due order, on the reinforced concrete column. Therefore, since a workability of the retrofit is excellent and the reinforcing plate is easily compressed on the surface of the concrete by a small lateral pressure, the reinforced concrete column may be reinforced sufficiently. Besides, a compressive strength of the reinforced concrete column may increase. In addition, the flexibility of the reinforcing plate and the energy absorption force of the reinforcing plate may increase.

Besides, the strip reinforcing plate is additional formed on the edge surface which is tightly attached by the weld of the reinforcing plates, and accordingly, the weakness of the welding portion is reinforced so that the welding portion is not damaged. Now, experimental examples are explained as follows.

EXPERIMENTAL EXAMPLES

1. Manufacture of the Reinforced Concrete Column Specimen, and Manufacture and Adhesion of the Reinforcing Plate The reinforced concrete column specimen with a 24 MPa design strength was used. The reinforcing plates was circular steel plates with 11.0 mm thickness and with 1.5 mm thickness. For double-layered jacket (Multi-layered jacket), two circular steel plates with 11.0 mm thickness (2.0 mm retrofit) was used.

Figure 5B:
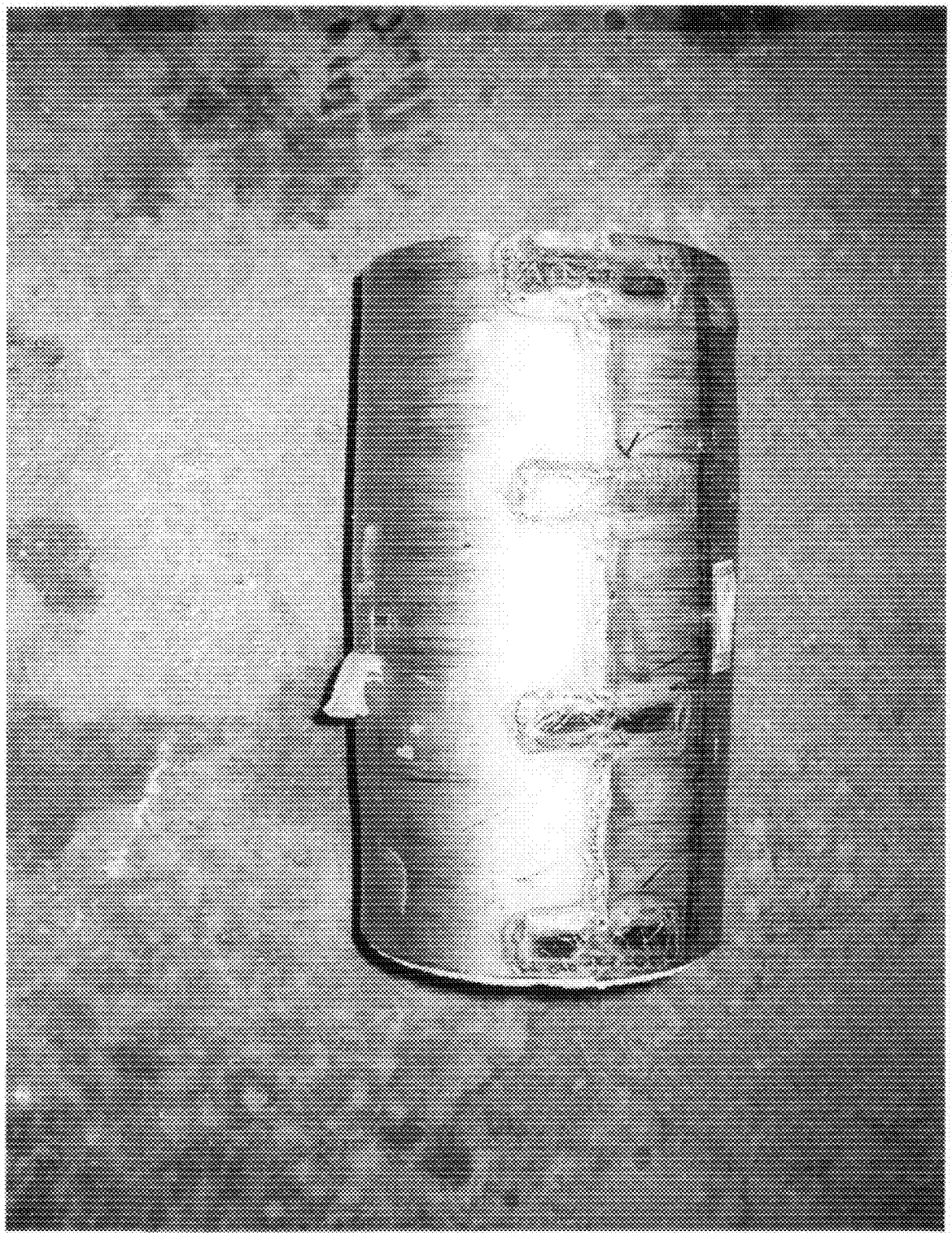
FIG. 5B illustrates a photograph for showing the substantially manufactured specimen.

In this double-layered jacket, three specimens (Referring to FIG. 5A, specimens 1, 2 and 3) was used in order to examine a behavior difference according to the weld process which was performed between the first reinforcing plate and the second reinforcing plate or not. The first specimen was used in case of no-welding between the reinforcing plates, the second specimen was used in case of a spot weld, and the third specimen was used in case of a line weld to be completely adhered (Referring to FIGS. 5A and 5B). FIG. 5A illustrates a table for showing a experimental results of a retrofitting method according to an embodiment of the present invention, and FIG. 5B illustrates a photograph for showing the substantially manufactured specimen.

2. The Compress of the Reinforcing Plate and the Compressed Results

Figure 6A:
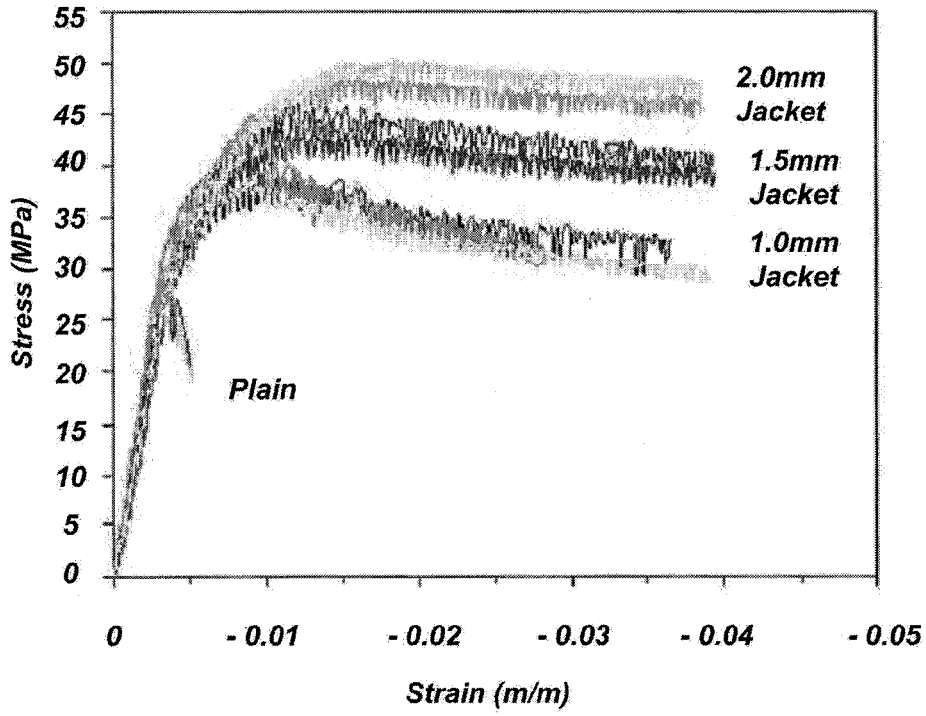
FIGS. 6A and 6B illustrate graphically effects of the retrofitting method according to an embodiment of the present invention, respectively.
Figure 6B:
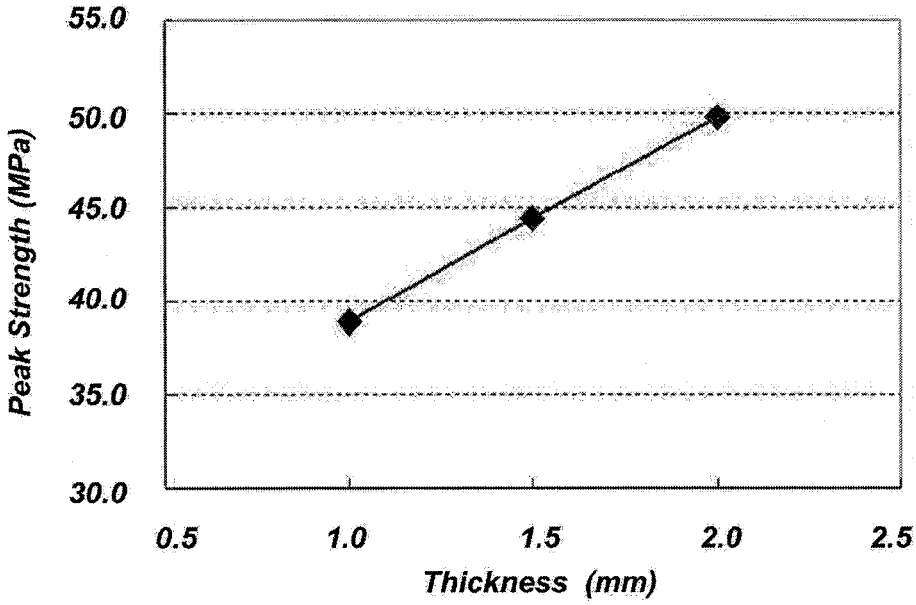

The compressed experimental results by multi-layered jacket of the reinforced concrete column according to the specimens was displayed as shown in FIG. 6A. Besides, each of the compressive strength of the specimens according to the results was provided along with a table in FIG. 5A. FIGS. 6A and 6B illustrate graphically effects of the retrofitting method according to an embodiment of the present invention, respectively.

After all, in case where the concrete column is entirely reinforced by means of the reinforcing plate 200, it may know the fact that the compressive strength and the flexibility of the concrete column may greatly increase in comparison with a plain. In addition, the effect of the compressive strength according to the thickness of the reinforcing plate shows 45.7, 65.9 and 86.0% in relation to 11.0 mm, 1.5 mm and 2.0 mm, respectively, and particularly, in the double-layered jacket (multi-layered jacket and 2.0 mm jacket) specimen, the first specimen was performed by a plain where the weld was not at the contact portion of the upper surface of the first retrofitting plate and the second reinforcing plate, the second specimen was performed by a spot weld, and the third specimen was performed by a line weld. Besides, the change of the compressive strength according to a welding characteristic between the reinforcing plates in the double-layered jacket may little occur, and therefore, the weld of the upper side of the first retrofitting plate and the second reinforcing plate have a little effect on the compressive strength and the flexibility according to the retrofit.

The change of the compressive strength according to the thickness of the reinforcing plates was displayed in a graph as shown in FIG. 6B, and accordingly, the change pattern shows a nearly linear relation.

Figure 7:
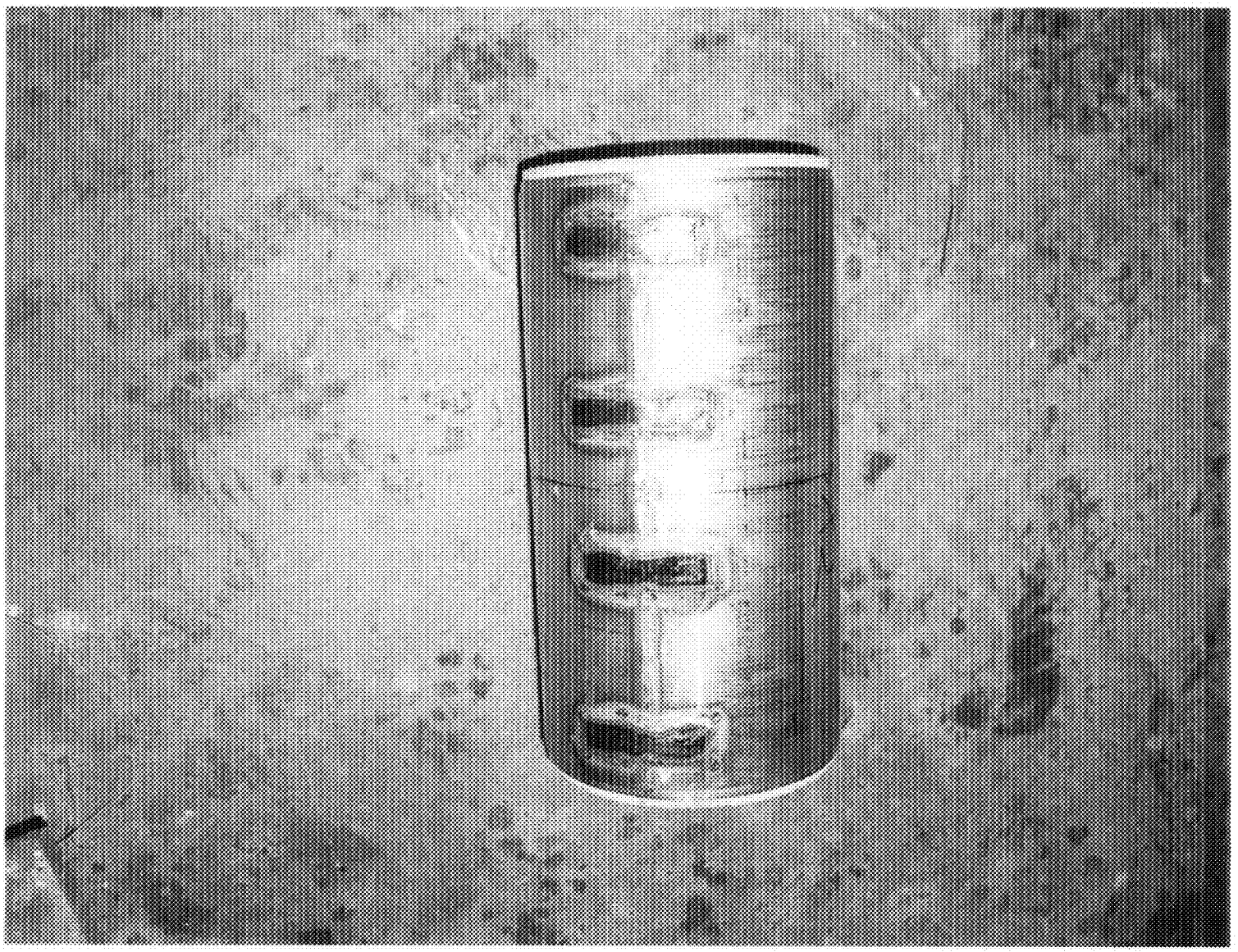
FIG. 7 illustrates a photograph for showing the final status of the specimen according to an embodiment of the present invention.

In this linear relation, when double-layered jacket (multi-layered jacket, and 2.0 mm jacket) is performed, it may know the fact that double-layer of 11.0 mm reinforcing plates has the same effect with one-layer of 2.0 mm reinforcing plate In a breakdown pattern of the specimens of this experiment, the breakdown in the welding portion did not occur as shown in FIG. 7. FIG. 7 illustrates a photograph for showing the final status of the specimen according to an embodiment of the present invention.

Since a bulging phenomena in the center of the specimens occurred sufficiently, it may know the fact that the strength and the flexibility of the reinforcing plates contributes to the increase of the compressive strength and flexibility of the specimens. Although the specimens was compressed 10 mm or more, the breakdown of the welding portion did not occur, and accordingly, the breakdown of the welding portion at the side of the reinforced concrete column may be controlled by a formation of the strip reinforcing plate.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although the embodiments of the present inventions have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. A method for retrofitting an already-formed reinforced concrete column using multi-layered steel plates, comprising the steps of:

pressing one single-piece first reinforcing plate on the already-formed reinforced concrete column where the one single-piece first reinforcing plate is equipped to directly contact with an outer surface of the already-formed reinforced concrete column and to wrap around a whole circumference of the already-formed reinforced concrete column;

tightly bonding an edge surface of the one single-piece first reinforcing plate with the other opposite edge surface of the same one single-piece first reinforcing plate by a first welding process for connecting the one single-piece first reinforcing plate on the already-formed reinforced concrete column so as to consolidate the one single-piece first reinforcing plate;

pressing a second reinforcing plate on the one single-piece first reinforcing plate where the second reinforcing plate is equipped to directly contact with and to wrap an outer surface of the one single-piece first reinforcing plate; and tightly bonding an edge surface of the second reinforcing plate with the other opposite edge surface of the same second reinforcing plate by a second welding process for connecting the second reinforcing plate on the one single-piece first reinforcing plate so as to consolidate the second reinforcing plate, wherein, at least double-layered or more reinforcing plates are compressed on the outer surface of the already-formed reinforced concrete column in sequence, and the first and second reinforcing plates are made from steel plates.

2. The retrofitting method of claim 1, wherein the second reinforcing plate is comprised of a plurality of reinforcing plates, and a strip reinforcing plate is further formed on an outermost reinforcing plate of the second reinforcing plate so as to traverse the bonded edge surfaces of the second reinforcing plate, the strip reinforcing plate being made from a steel plate.

3. The retrofitting method of claim 1, wherein the first and second reinforcing plates are made from the same thickness or different thickness.

4. The retrofitting method of claim 3, wherein the already-formed reinforced concrete column is a circular sectioned reinforced concrete column.

5. The retrofitting method of claim 1, wherein the first and second reinforcing plates are of a same thickness.

6. A retrofit for an already-formed reinforced concrete column using multi-layered steel plates, comprising:

one single-piece first reinforcing plate being equipped and compressed to directly contact with an outer surface of the already-formed reinforced concrete column and wrap around a whole circumference of the already-formed reinforced concrete column, the one single-piece first reinforcing plate having only one welded portion formed from tightly attaching both opposite edge surfaces of the same one single-piece first reinforcing plate by a first welding process so as to connect the one single-piece first reinforcing plate around the already-formed reinforced concrete column, wherein the one single-piece first reinforcing plate is made from a single-piece steel plate;

a second reinforcing plate being equipped and compressed to directly contact with and to wrap an outer surface of the one single-piece first reinforcing plate, the second reinforcing plate having one welded portion formed from tightly attaching both opposite edge surfaces of the same second reinforcing plate by a second welding process so as to connect the second reinforcing plate around the one single-piece first reinforcing plate, wherein the second reinforcing plate is made from at least one layer or more steel plates; and at least one or more strip reinforcing plates being formed on an outermost steel plate of the second reinforcing plate by a third welding process so as to traverse the attached edge surfaces of the second reinforcing plate, wherein the strip reinforcing plate is made from a steel plate.

7. The retrofit of claim 6, wherein the already-formed reinforced concrete column and the first and second reinforcing plates are circular sectioned, and the first and second reinforcing plates are reinforcing plates made from the same thickness or different thickness.

8. The retrofit of claim 6, wherein the already-formed reinforced concrete column and the first and second reinforcing plates are circular sectioned, and the first and second reinforcing plates are of a same thickness.

* * * * *